US007866032B2

(12) United States Patent
Wu et al.

(10) Patent No.: US 7,866,032 B2
(45) Date of Patent: Jan. 11, 2011

(54) METHOD OF MANUFACTURING METAL KEYPAD PANEL WITH MICROPORE ARRAY

(75) Inventors: Che-Tung Wu, Taoyuan (TW); Chih-Ho Hsu, Taoyuan (TW)

(73) Assignee: Ichia Technologies, Inc., Taoyuan (TW)

( * ) Notice: Subject to any disclaimer, the term of this patent is extended or adjusted under 35 U.S.C. 154(b) by 473 days.

(21) Appl. No.: 11/957,771

(22) Filed: Dec. 17, 2007

(65) Prior Publication Data

US 2009/0126186 A1 May 21, 2009

(51) Int. Cl.
*H01H 11/00* (2006.01)
*H01H 65/00* (2006.01)

(52) U.S. Cl. ..... 29/622; 29/846; 29/848; 200/313; 200/314; 200/341

(58) Field of Classification Search ..... 29/622, 29/846, 848, 874, 876, 881, 882; 200/94, 200/313, 314, 341, 514; 216/94
See application file for complete search history.

(56) References Cited

U.S. PATENT DOCUMENTS 7,034,235 B2 * 4/2006 Hosaka ..... 200/314
7,674,992 B2 * 3/2010 Hutchison et al. ..... 200/314
2007/0205986 A1 9/2007 Kim
2009/0236209 A1 * 9/2009 Ishii ..... 200/341

FOREIGN PATENT DOCUMENTS

JP 2007-115633 5/2007

* cited by examiner

*Primary Examiner*—Thiem Phan
(74) *Attorney, Agent, or Firm*—Chun-Ming Shih; HDLS IPR Services

(57) ABSTRACT

In a method of manufacturing a metal keypad panel with a micropore array, a metal laminate is prepared and etched to form micropores on the metal laminate, and a filling is coated on a surface of the metal laminate and permeated into the micropores. After the metal laminate is punched to form a metal keypad panel in a predetermined shape, the metal keypad panel is put into a mold. After a plastic material is injected into the mold, a pattern layer is formed on a side of the metal keypad panel, and then a backlight module is attached onto another side of the metal keypad panel. The backlight module has patterns, and the shape of the patterns is formed by arranging light guide microstructures. Finally, an electric signal module is attached onto a side of the backlight module to complete manufacturing the metal keypad panel.

7 Claims, 20 Drawing Sheets

METHOD OF MANUFACTURING METAL KEYPAD PANEL WITH MICROPORE ARRAY

BACKGROUND OF THE INVENTION

1. Field of the Invention

The present invention generally relates to a keypad panel, and more particularly to a method of manufacturing a metal keypad panel.

2. Description of Prior Art

As communication technologies advance continuously, many electronic products are manufactured with a light, thin, short and small design to reduce the size and weight of the electronic products and facilitate users to carry the electronic products. To reduce the size and weight of an electronic product, designers and manufacturers reduce the volume of internal integrated circuits as well as the area and thickness of the operating interface on a surface of the electronic product before the electronic product is installed to a communication device.

Referring to FIG. 1(*a*) for a traditional metal keypad panel as disclosed in U.S. Application Pat. No. 2007/0205986A1, the metal keypad panel 10*a* of this patent application includes an elastic layer 1*a*, and a side of the elastic layer 1*a* includes a plurality of protrusions 11*a*, and another side of the elastic layer 1*a* corresponding to the protrusion 11*a* includes a plurality of metal press keys 2*a*, and each of the metal press keys 2*a* has a hollow portion 21*a* with a corresponding pattern, and a light transmitting resin layer 22*a* is filled into the hollow portion 21*a*. When the metal keypad panel 10*a* is installed into a base 20*a* of an electronic device, the metal keypad panel 10*a* is situated on the electric signal module 30*a*, and the electric signal module 30*a* has a printed circuit board 31*a*, and the printed circuit board 31*a* has a plurality of immovable contact points 32*a* disposed thereon, and a metal plate 33*a* is installed onto the circuit board 31*a*. The metal plate 33*a* has a plurality of domes 331 with an arc surface, and each dome 331*a* corresponds to each contact point 32*a*, and another side of the dome 331*a* corresponds to the protrusion 11*a*. If the metal press key 2*a* is pressed, the protrusion 11*a* is pressed onto the surface of the dome 331*a* to deform the dome 331*a* and contact with the contact point 32*a* to generate an electric signal output. When the backlight source is lit, the light of the backlight source can be passed through a resin layer 22*a* of the metal press key 2*a* to allow users to see the position of each press key clearly.

Although the metal keypad panel 10*a* is manufactured with a light, thin, short and compact design and can be installed and used in a small electronic device, its manufacture requires filling a resin layer 22*a* to a hollow portion 21*a* of all metal press key 2*a* one by one, and then attaching the metal press keys 2*a* onto a side of the elastic layer 1*a* one by one, and thus the manufacture of the metal keypad panel 10*a* takes much time and effort and technically involves a high level of difficulty. After the metal keypad panel 10*a* is assembled and combined with the base 20*a*, a gap is formed between the periphery of the metal press key 2*a* and the base 20*a*, and thus dusts may be accumulated at the exterior of the keypad panel 10*a* or water may enter into the interior easily, and finally causing an unsmooth operation of the press keys or a short circuit to the internal circuits. Furthermore, there is no reflective effect of any bright line on surfaces of the metal keypad panel 10*a*, so that the metal keypad panel 10*a* is extremely dull in appearance.

SUMMARY OF THE INVENTION

It is a primary objective of the present invention to overcome the foregoing shortcomings by providing a novel method of manufacturing a metal keypad panel, such that the metal keypad panel can be manufactured easily, and accumulated dusts and permeated water can be avoided. In addition, micropores and light guide microstructures are used for displaying patterns on the surface of press keys, and a pattern layer provides a bright wavy line effect to the surface of the metal keypad panel to improve the overall appearance and visual effect of the metal keypad panel.

To achieve the foregoing objective, the present invention provides a method of manufacturing a metal keypad panel with a micropore array, and the method comprises the steps of: preparing a metal laminate; etching the metal laminate to form a plurality of micropores on the metal laminate; forming a meshed metal keypad panel by a micropore array method; coating a filling onto a surface of the metal laminate and permeating the filling into the micropore; punching the metal laminate to form the metal keypad panel in a predetermined shape; putting the metal keypad panel into a mold and forming a pattern layer on a side of the metal keypad panel after injecting a plastic material; attaching a backlight module onto another side of the metal keypad panel, and the backlight module has a corresponding pattern, and the shape of the pattern is formed by arranging a plurality of light guide microstructures; attaching an electric signal module on a side of the backlight module, and the electric signal module is comprised of a flexible printed circuit board, and the flexible printed circuit board has a plurality of contact points, and each contact point corresponds to a metal dome; coating an adhesive layer onto a side of the circuit board and the metal dome, and the adhesive layer is adhered to a layer of an dome membrane; coating an adhesive block on a side of a protruding position of the dome membrane; adhering each adhesive block onto a protrusion, and the protrusion corresponds to the pattern on each light guide plate; and installing a light source module at a distal side of the circuit board, and the light source module corresponds to a side of the light guide plate.

DETAILED DESCRIPTION OF THE INVENTION

The technical characteristics, features and advantages of the present invention will become apparent in the following detailed description of the preferred embodiments with reference to the accompanying drawings.

Figure 1A:
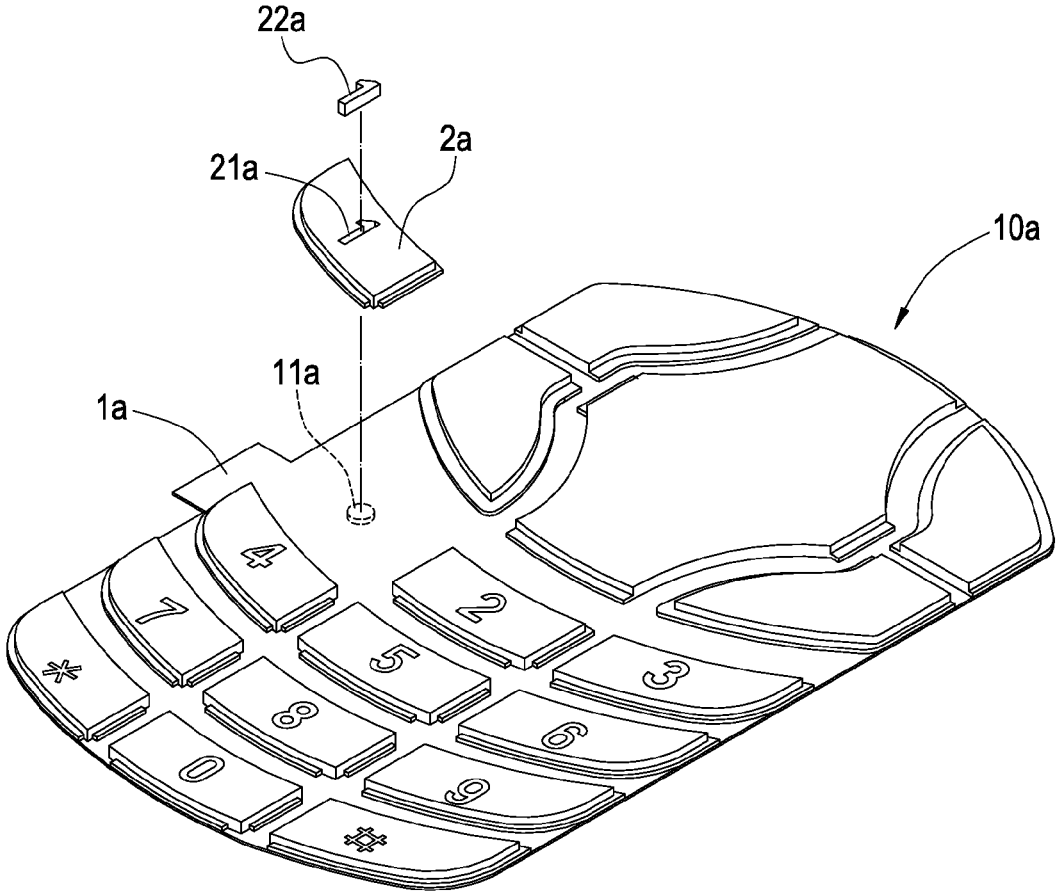
FIG.1(a) PRIOR ART
FIGS. 1(*a*) and 1(*b*) are schematic views of a traditional metal keypad panel.
Figure 1B:
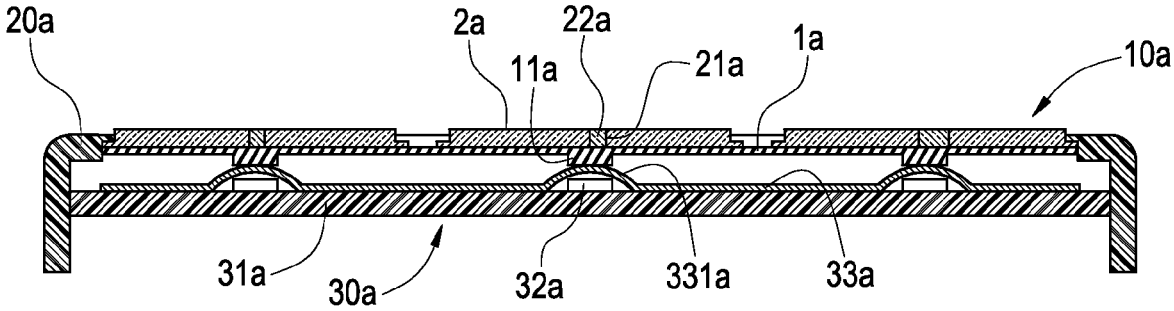
FIG.1(b) PRIOR ART
Figure 2:
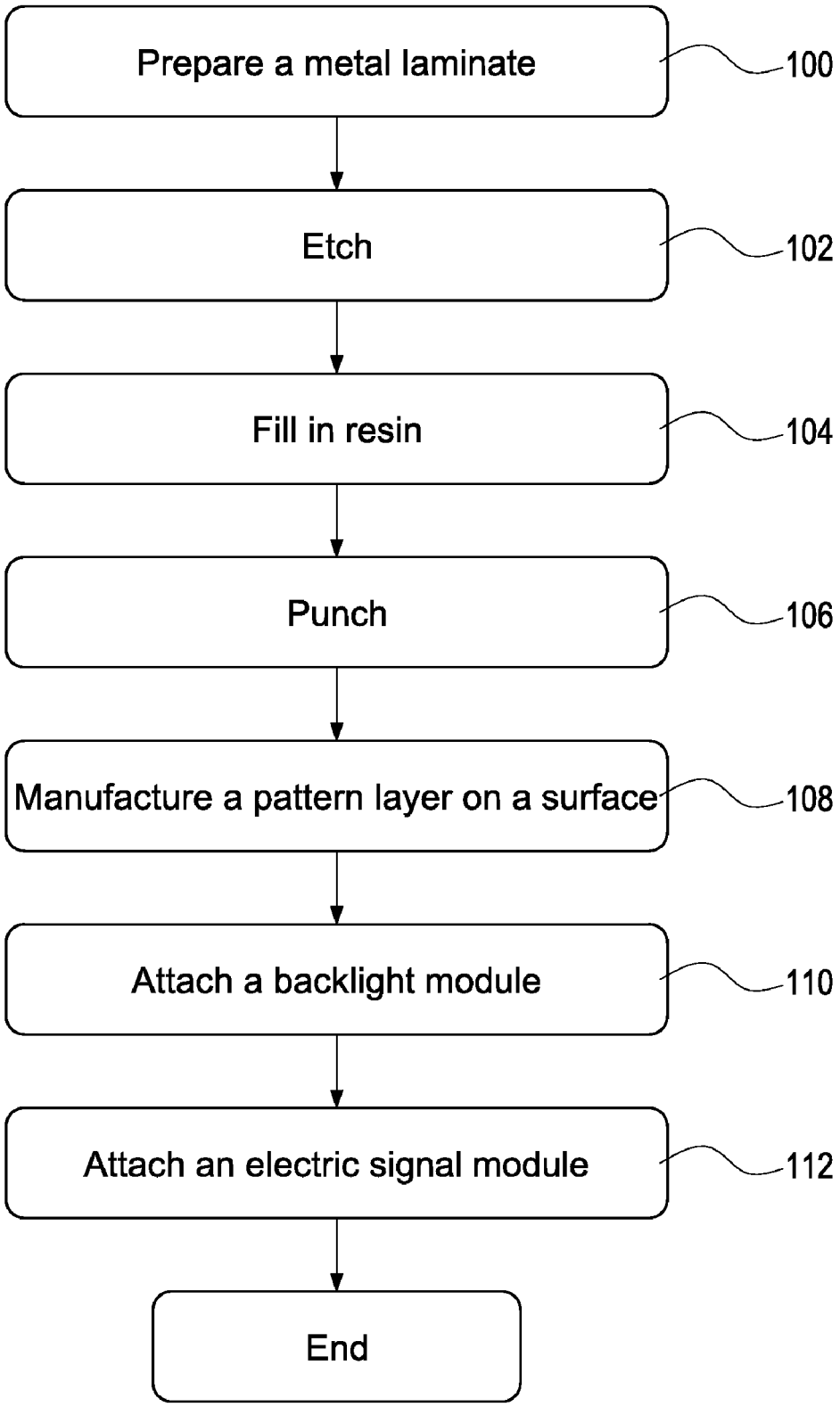
FIG. 2 is a flow chart of manufacturing a metal keypad panel of the present invention.
Figure 3A:
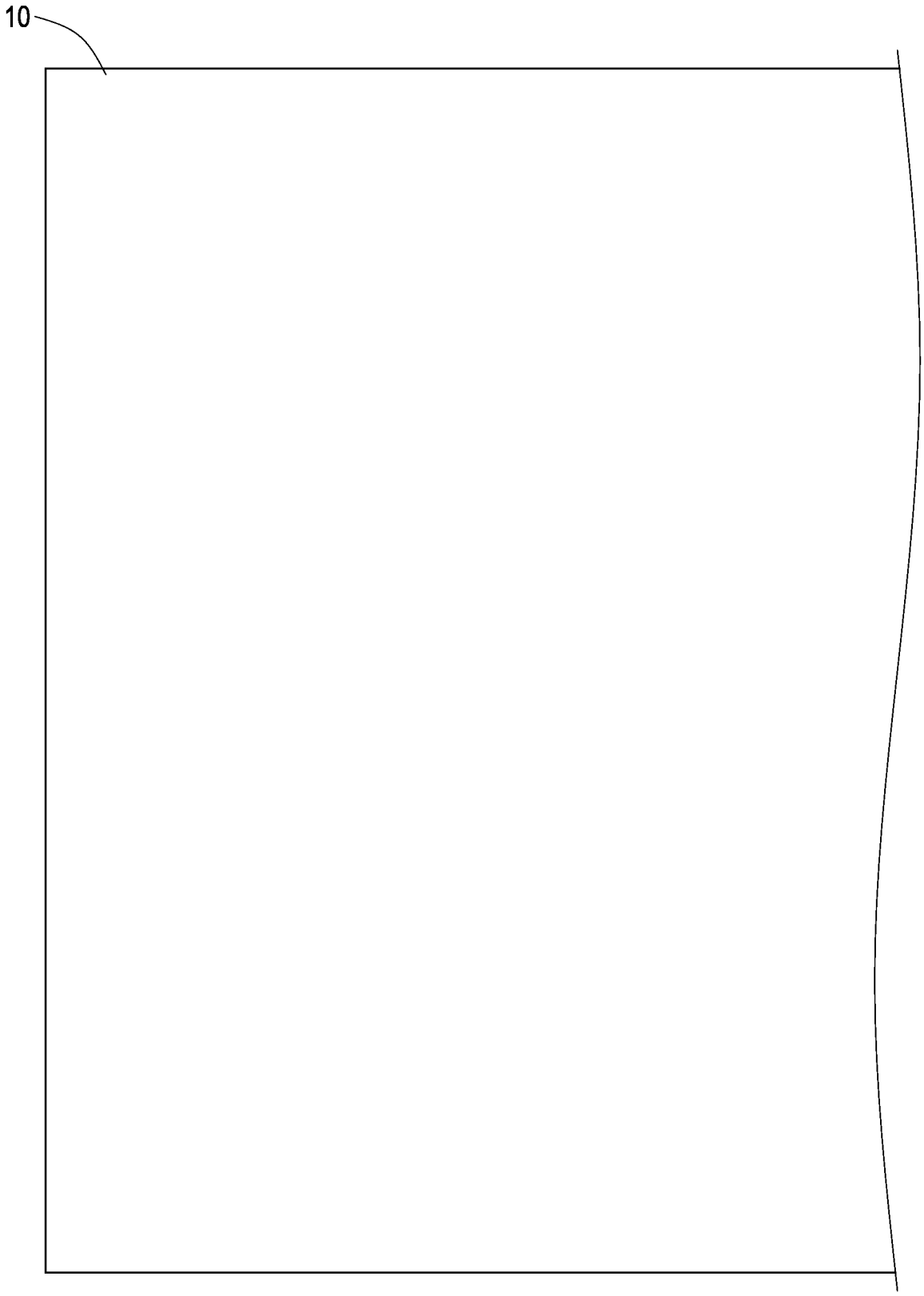
FIGS. 3(*a*) to 3(*i*) are schematic views of a manufacturing flow of a metal keypad panel in accordance with the present invention.
Figure 3B:
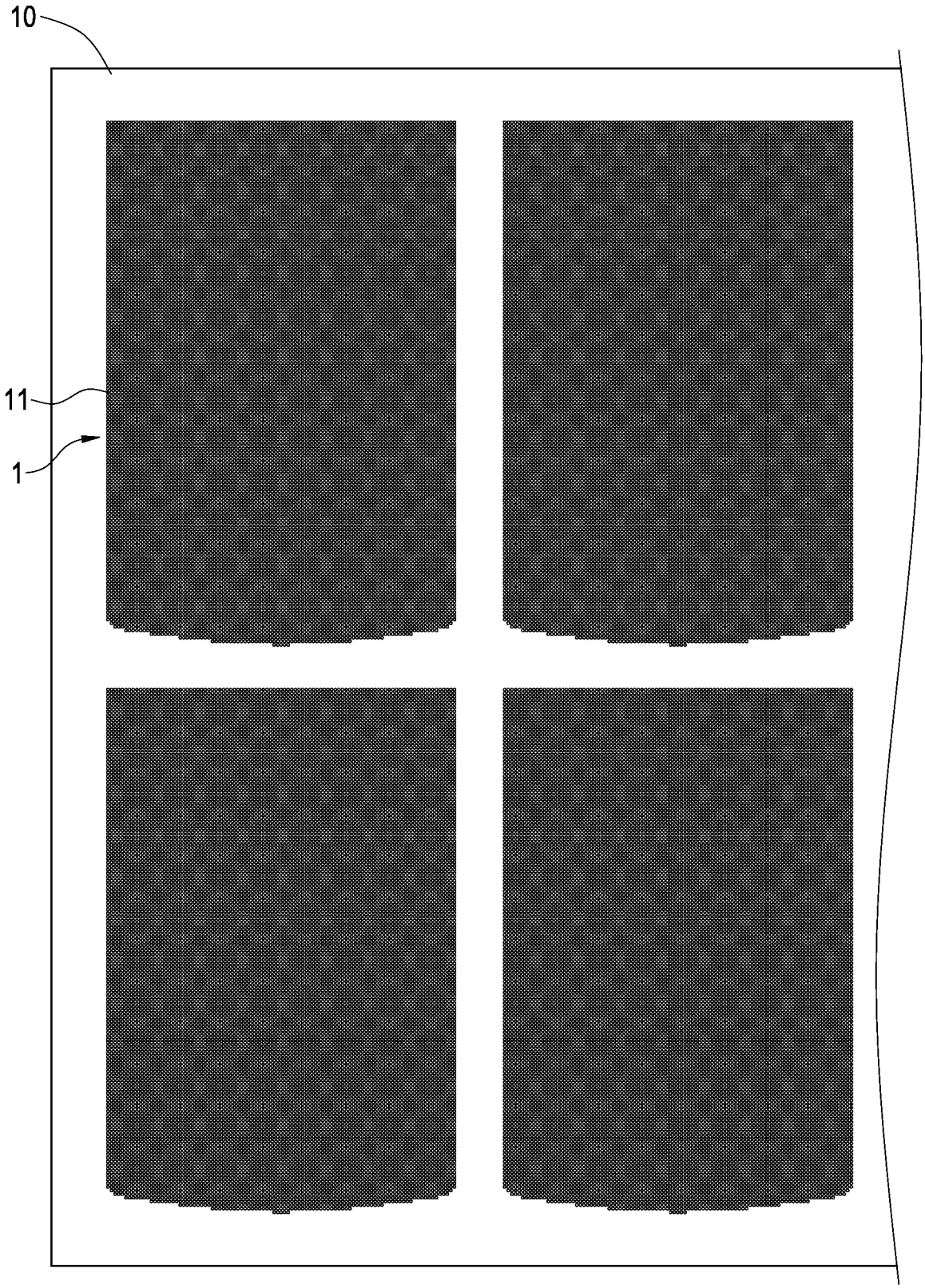
Figure 3C:
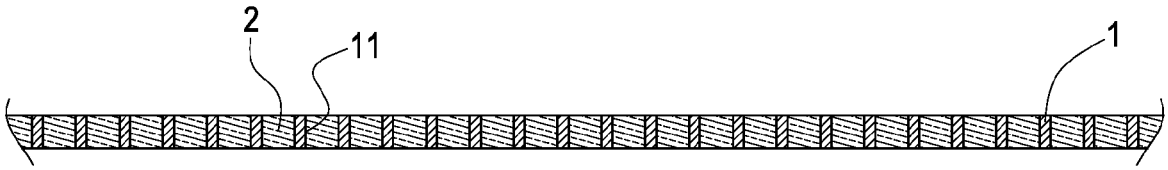
Figure 3D:
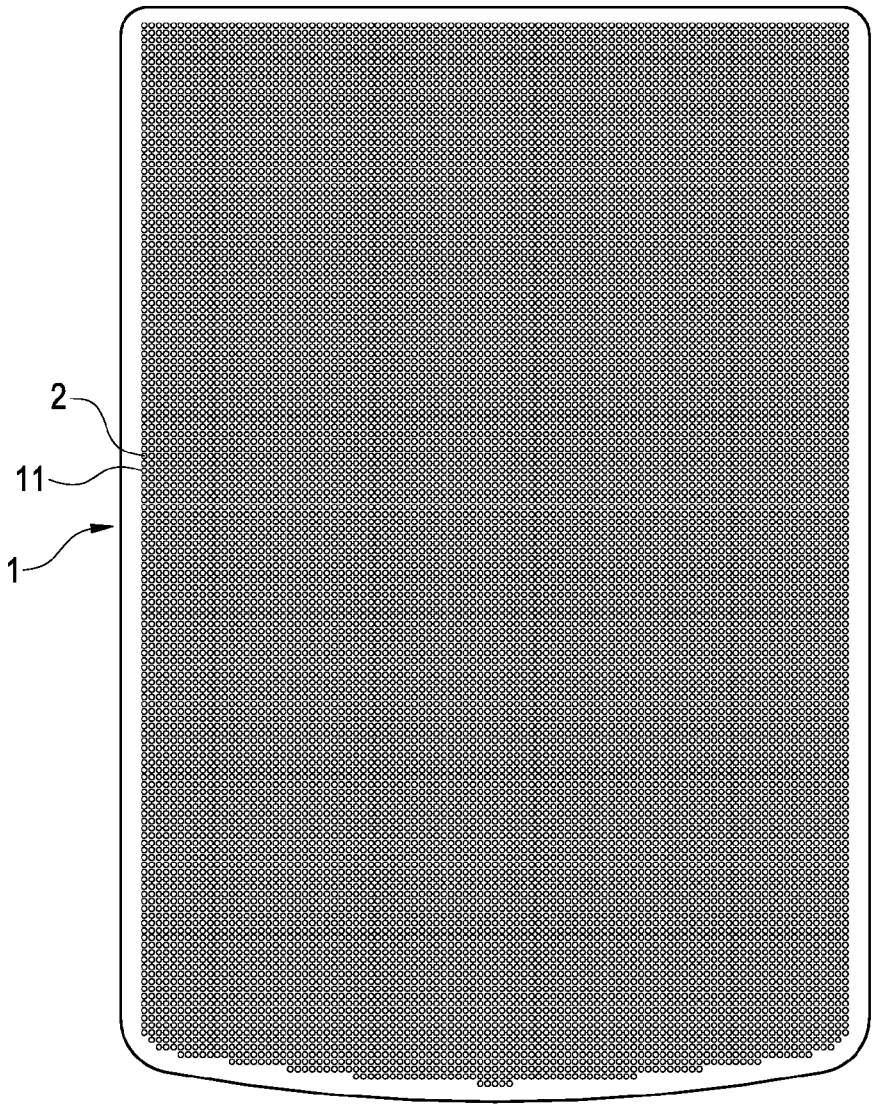
Figure 3E:
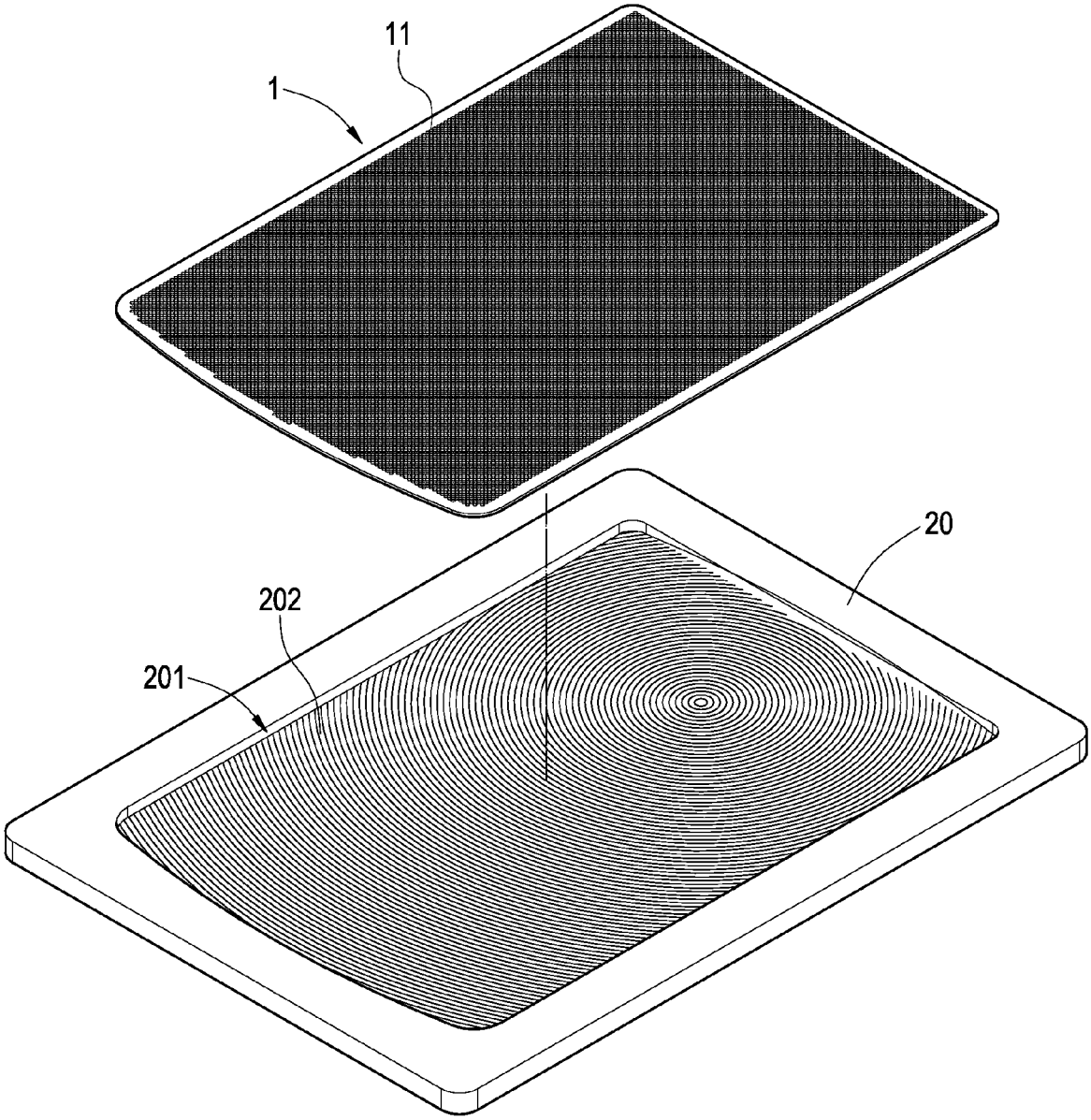
Figure 3F:
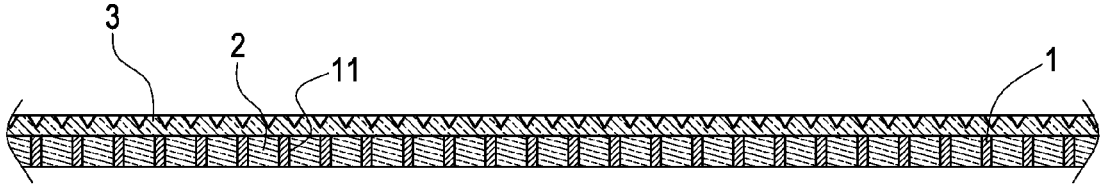
Figure 3G:
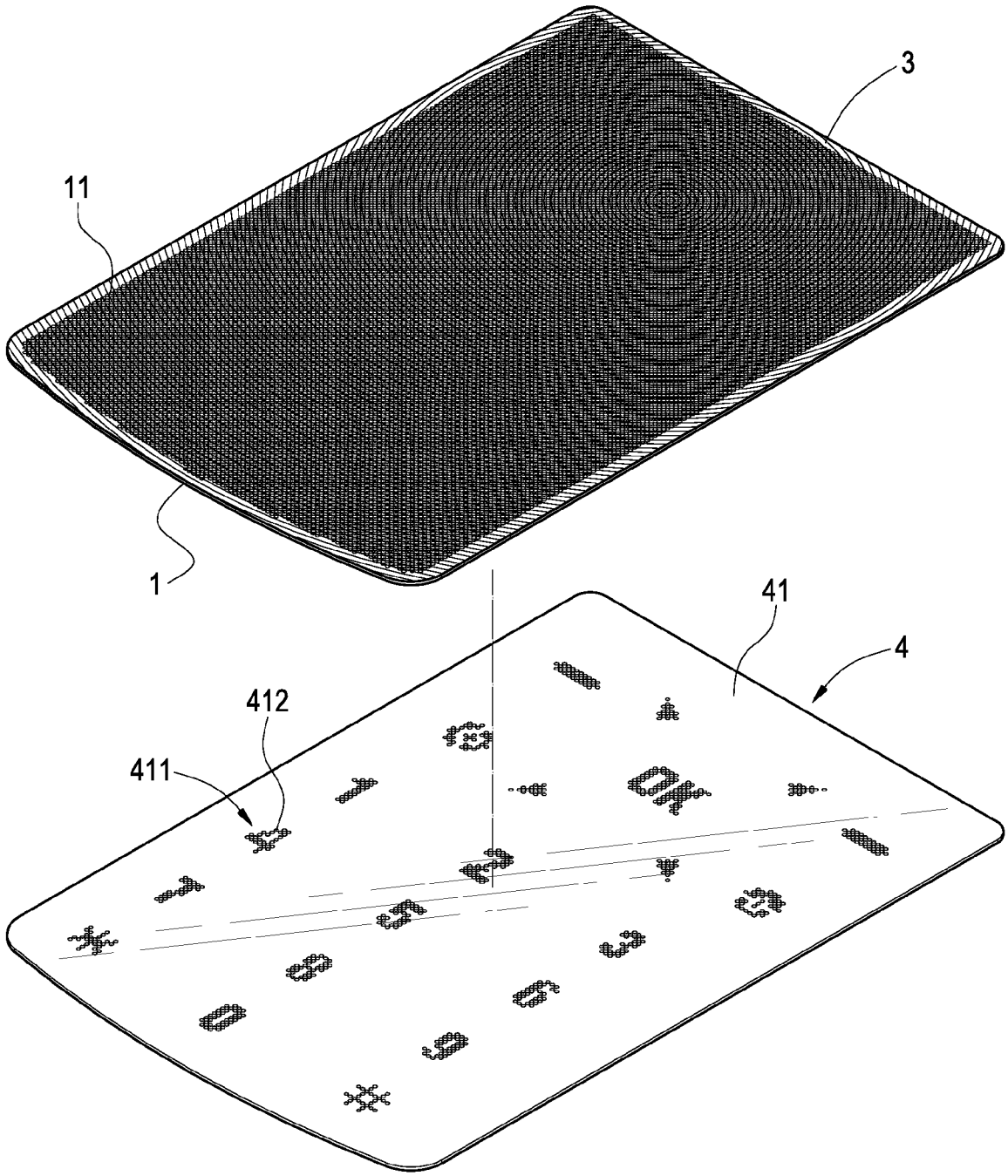
Figure 3H:
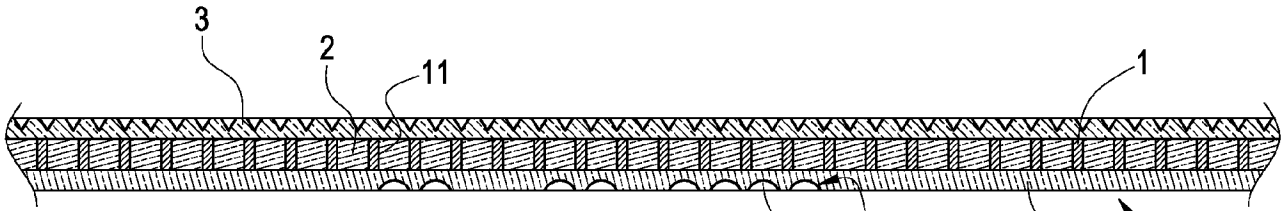
Figure 3I:
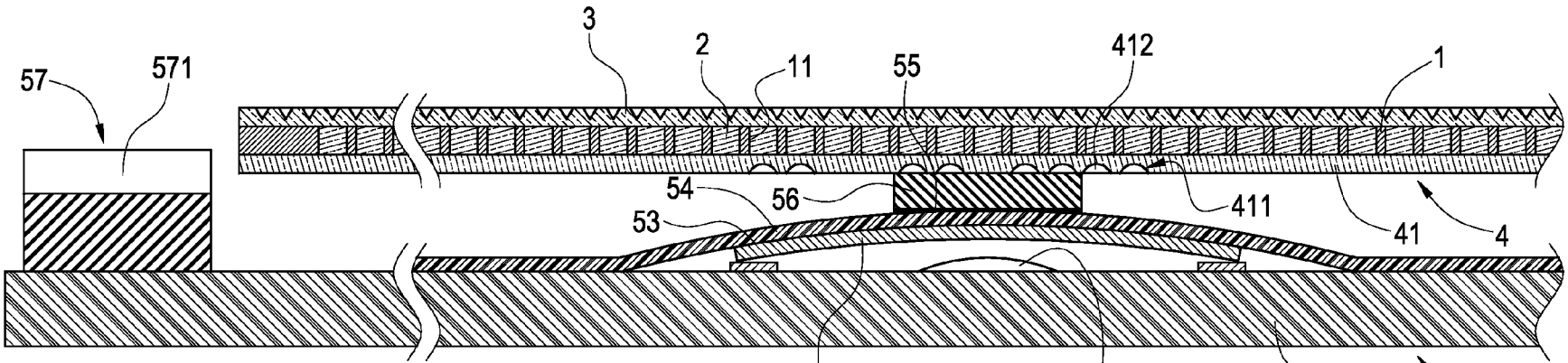

Referring to FIG. 2 for a flow chart of manufacturing a metal keypad panel in accordance with the present invention, the method of manufacturing a metal keypad panel with a micropore array comprises the following steps:

Step 100: Prepare a metal laminate 10 as shown in FIG. 3(*a*), wherein the metal laminate 10 is a material selected from a stainless steel (SUS) or an aluminum-magnesium alloy.

Step 102 (Etching): Etch the metal laminate 10 to form a plurality of micropores 11 on the metal laminate 10, wherein a meshed metal keypad panel 1 as shown in FIG. 3(*b*) is formed by an array arrangement of micropores 11.

Step 104 (Filling micropores): Coat a filling 2 onto a surface of the metal keypad panel 1, and permeate the filling 2 into the micropores 11 as shown in FIG. 3(*c*), wherein the filling 2 as shown in the figure is a ultraviolet glue, a silicone, a vitro, an epoxy or a synthetic resin.

Step 106 (Punching): Punch the metal laminate 10 to form a metal keypad panel 1 in a predetermined shape as shown in FIG. 3(*d*).

Step 108 (Producing a surface pattern layer): Put the metal keypad panel 1 into a mold 20, and inject a plastic material such as thermoplastic polyurethane (TPU) or thermoplastic elastomer (TPE) into a mold cavity 201 of the mold 20, so that the plastic material is attached onto a side of the filling 2. In the meantime, lines 202 on the internal surface of the mold cavity 201 form a pattern layer 3 by the plastic material as shown in FIGS. 3(*e*) and 3(*f*), and the pattern layer 3 has a wavy bright spinning. In addition, the pattern layer 3 also constitutes a protecting layer of the metal keypad panel 1.

Step 110 (Attaching a backlight module 4): Attach a light guide plate 41 onto a side of the metal keypad panel 1, and the light guide plate 41 can be formed on a side of the metal keypad panel 1*a* by a thermal press method, and a pattern 411 of the corresponding press key is stamped and formed on the light guide plate 41, and the shape of the pattern 411 is formed by arranging a plurality of light guide microstructures 412, and the light guide microstructure 412 is concavely disposed in the light guide plate 41 or convexly disposed on a side of the light guide plate 41*a*. The shape of the pattern 411 can be a number, a text, a special symbol (#, *, .) and a direction symbol as shown in FIGS. 3(*g*) and 3(*h*). The light guide plate 41 can be formed on a side of the metal keypad panel 1 first by an injection molding method, and after the light guide plate 41 is manufactured, laser (not shown in the figure) is applied onto the light guide plate 41 to engrave the shape of the pattern 411.

Step 112 (Attaching an electric signal module 5): Attach an electric signal module 5 onto a side of the backlight module 4, and the electric signal module 5 includes a flexible printed circuit board (FPCB) 51, and the flexible printed circuit board 51 has a plurality of contact points 511, and each contact point 511 corresponds to a metal dome 52. Coat an adhesive layer 53 onto a side of the circuit board 51 and the metal dome 52, and the adhesive layer 53 is adhered to a layer of an dome membrane 54. Coat an adhesive block 55 on a side at a protruding position of the dome membrane 54, and adhere a protrusion 56 on each adhesive block 55, and the protrusion 56 corresponds to each pattern 411 of the light guide plate 41. Install a light source module 57 onto a distal side of the circuit board 51, wherein the light source module 57 is comprised of a plurality of light emitting diodes 571, and a position of the light emitting diode 571 for producing a light source corresponds to a side of the light guide plate 41 as shown in FIG. 3(*i*) to complete manufacturing the metal panel.

Figure 4A:
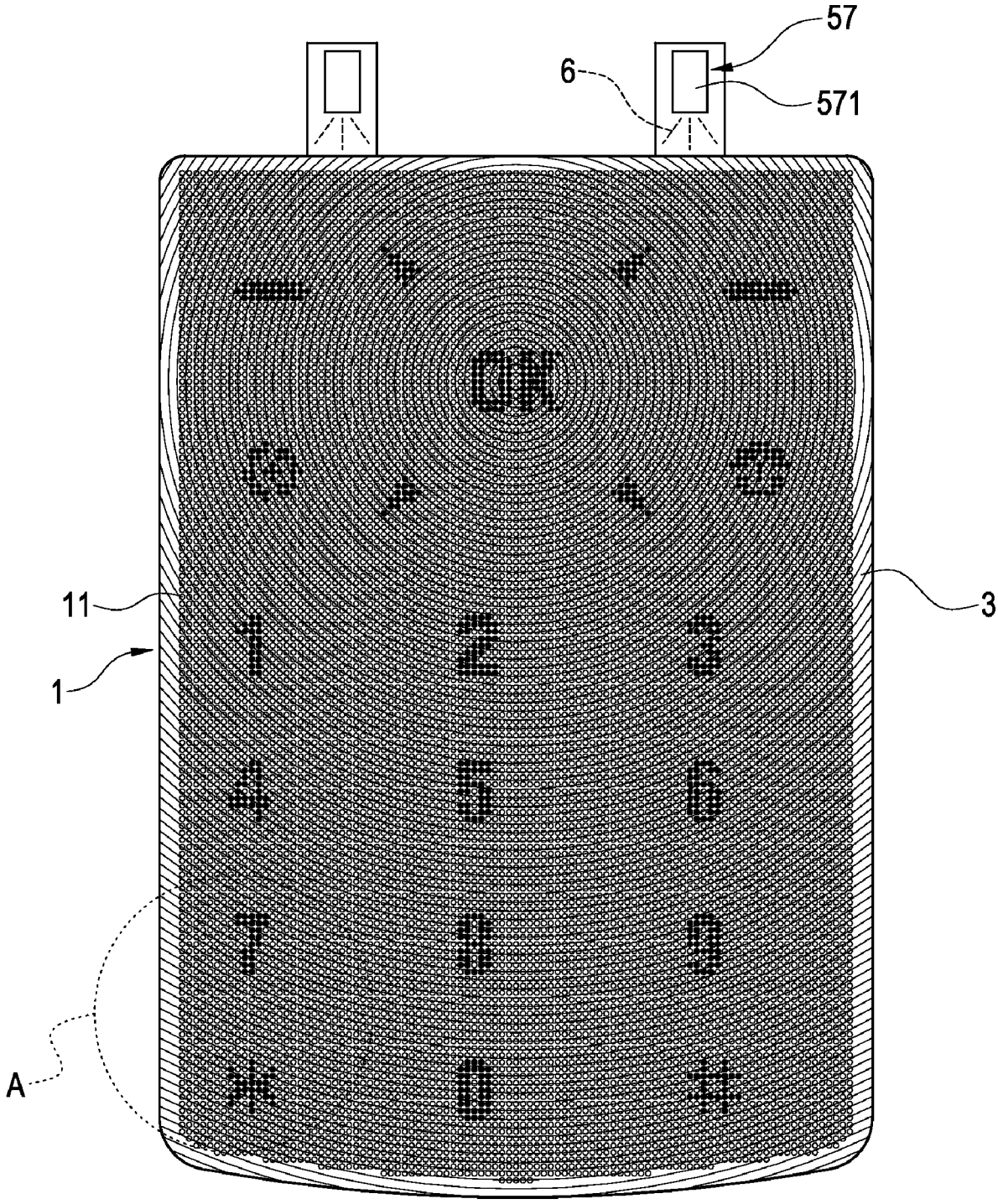
FIGS. 4(*a*) and 4(*b*) are a schematic view of a lit backlight module and an enlarged view of a portion of FIG. 4(*a*) respectively.
Figure 4B:
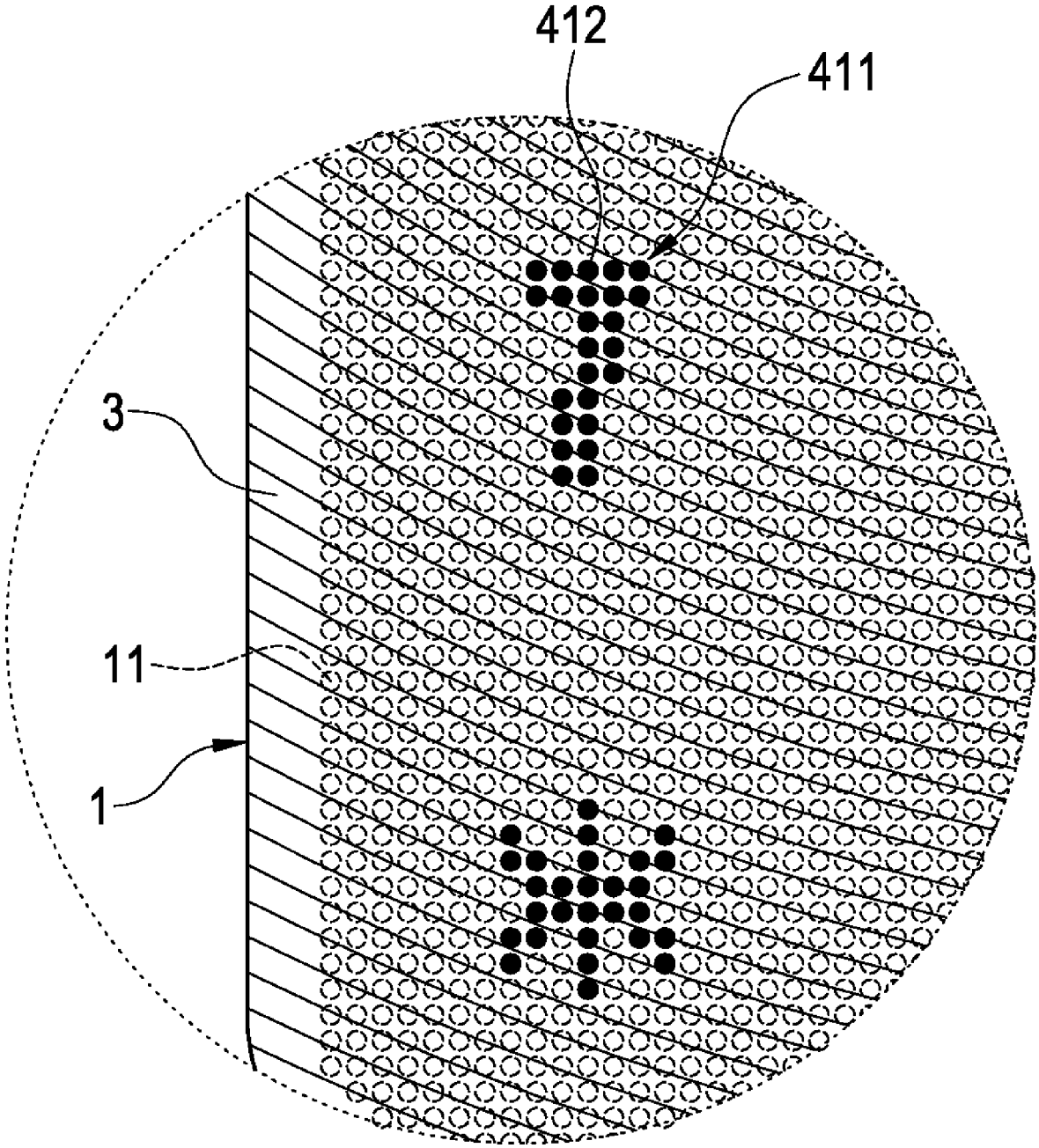

Referring to FIGS. 4(*a*) and 4(*b*) for a schematic view of a lit backlight module of the invention and an enlarged view of a portion of FIG. 4(*a*) respectively, a light 6 produced by the light emitting diode 571 of the light source module 57 on the circuit board 51 is guided from a side of the light guide plate 41 when the metal keypad panel 1 is operated. After the light 6 passes through the light guide microstructure 412 of the light guide plate 41, the light guide microstructure 412 focuses and projects the light 6 onto the corresponding metal keypad panel 1, and the pattern 411 displayed by the light guide microstructure becomes clearer (or brighter) on the metal keypad panel 1, so that users can see the position of each press key clearly.

Figure 5A:
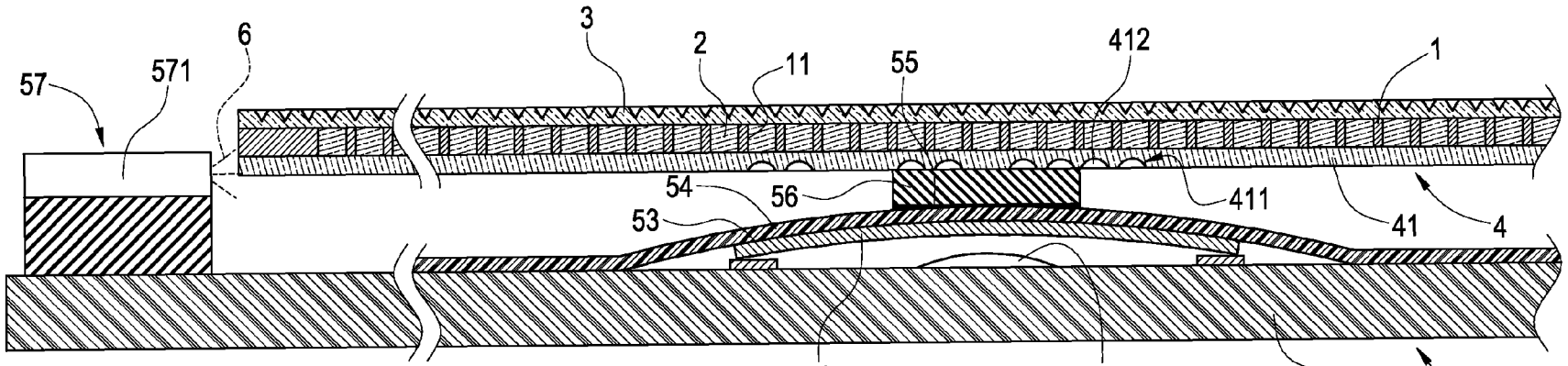
FIGS. 5(*a*) and 5(*b*) are schematic views of pressing a metal keypad panel in accordance with the present invention.
Figure 5B:
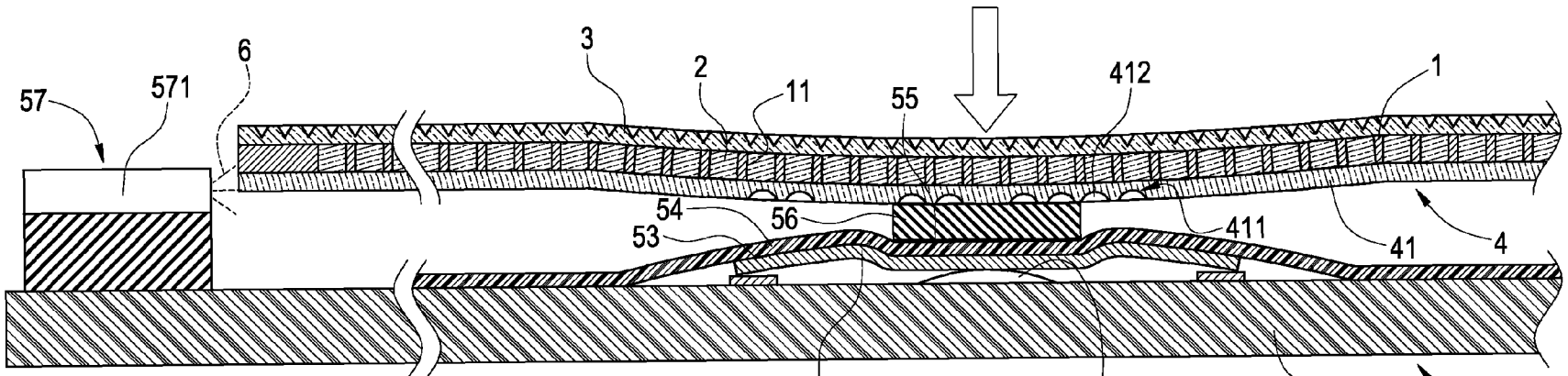

Referring to FIGS. 5(*a*) and 5(*b*) for schematic views of pressing a metal keypad panel in accordance with the present invention, if an external force is applied onto a side of the metal keypad panel 1 to deform the metal keypad panel 1 and drive the protrusion 56 to press down onto the dome membrane 54, the metal dome 52 will be deformed to press down at a position connected to the contact point 511 to generate a conducting signal output.

If no external force is applied onto a side of the metal keypad panel 1, the metal panel 1 will rise to its original position automatically by the resilience of the metal keypad panel 1 and the metal dome 52.

Figure 6A:
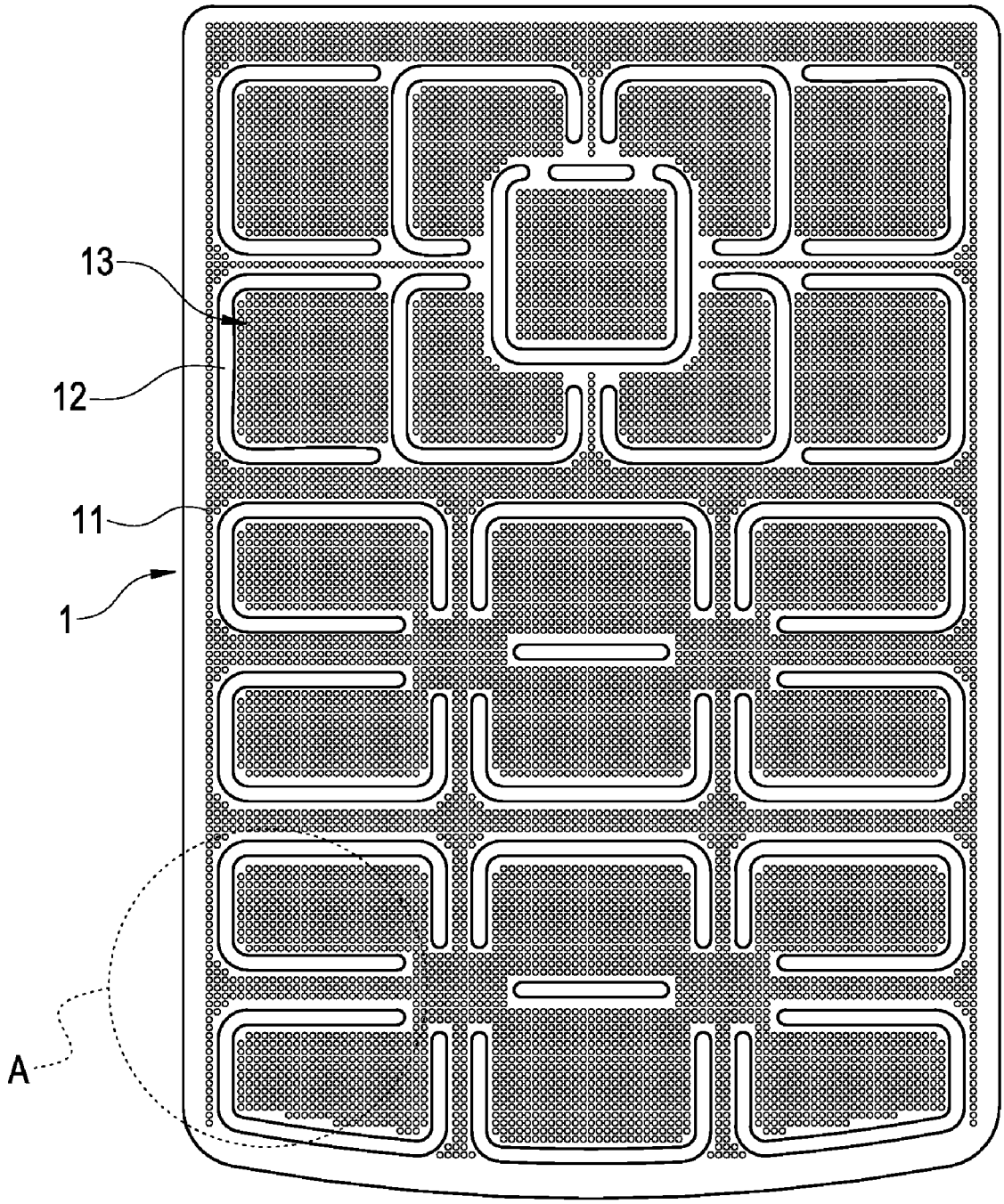
FIGS. 6(*a*) and 6(*b*) are a schematic view of another preferred embodiment of the present invention and an enlarged view of a portion of FIG. 6(*a*) respectively.
Figure 6B:
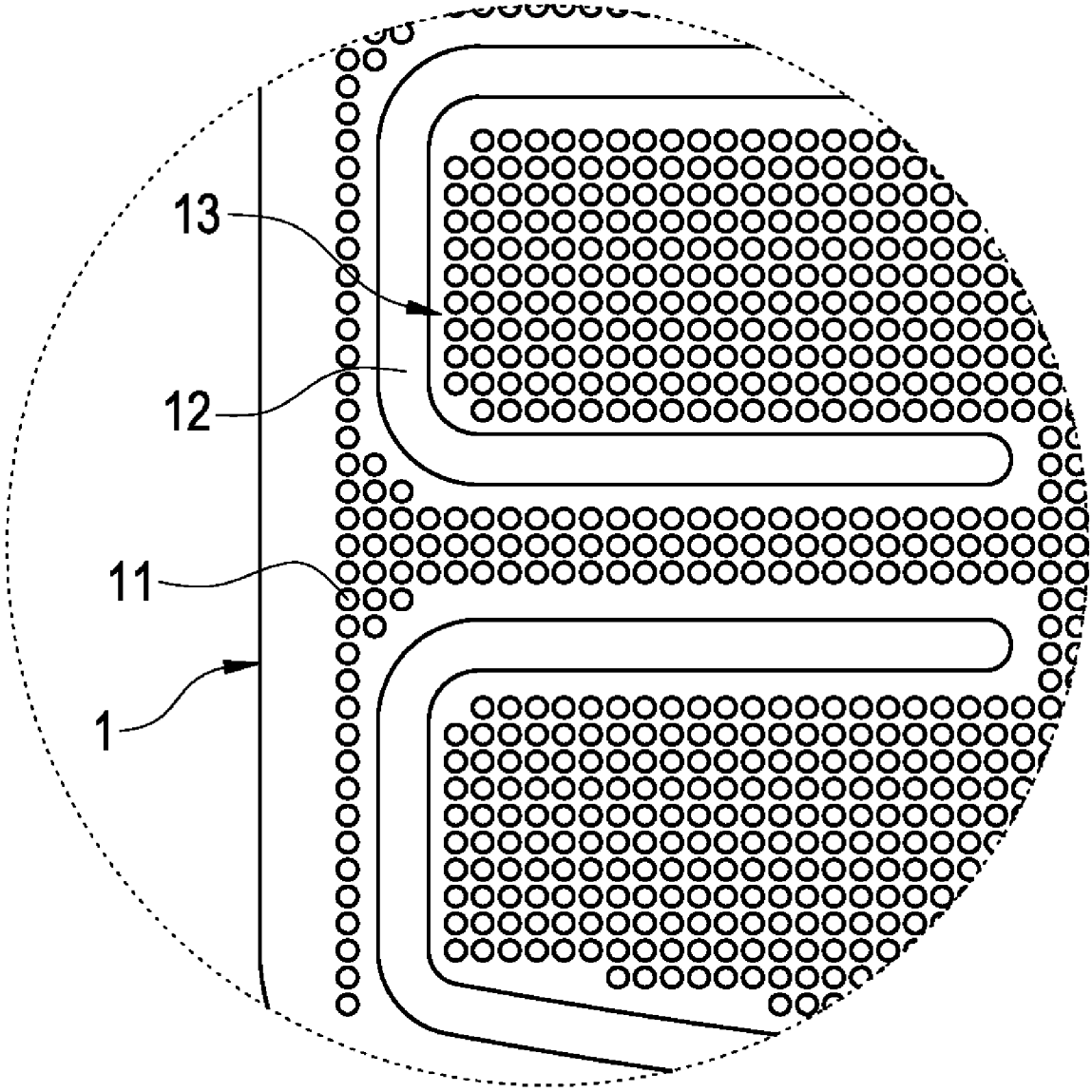

Referring to FIGS. 6(*a*) and 6(*b*) of a schematic view of another preferred embodiment of the invention and an enlarged view of a portion of FIG. 6(*a*) respectively, a line hollow portion 12 can be etched and formed on the micropores 11, while the metal keypad panel 1 is being etched to form the micropores 11 as described in Step 102, and the line hollow portion 12 is enclosed to form a press zone 13, and the press zone 13 clearly defines the allocated position of each press key, and the hollow portion 12 allows users to press the press zone 13 easily.

Figure 7A:
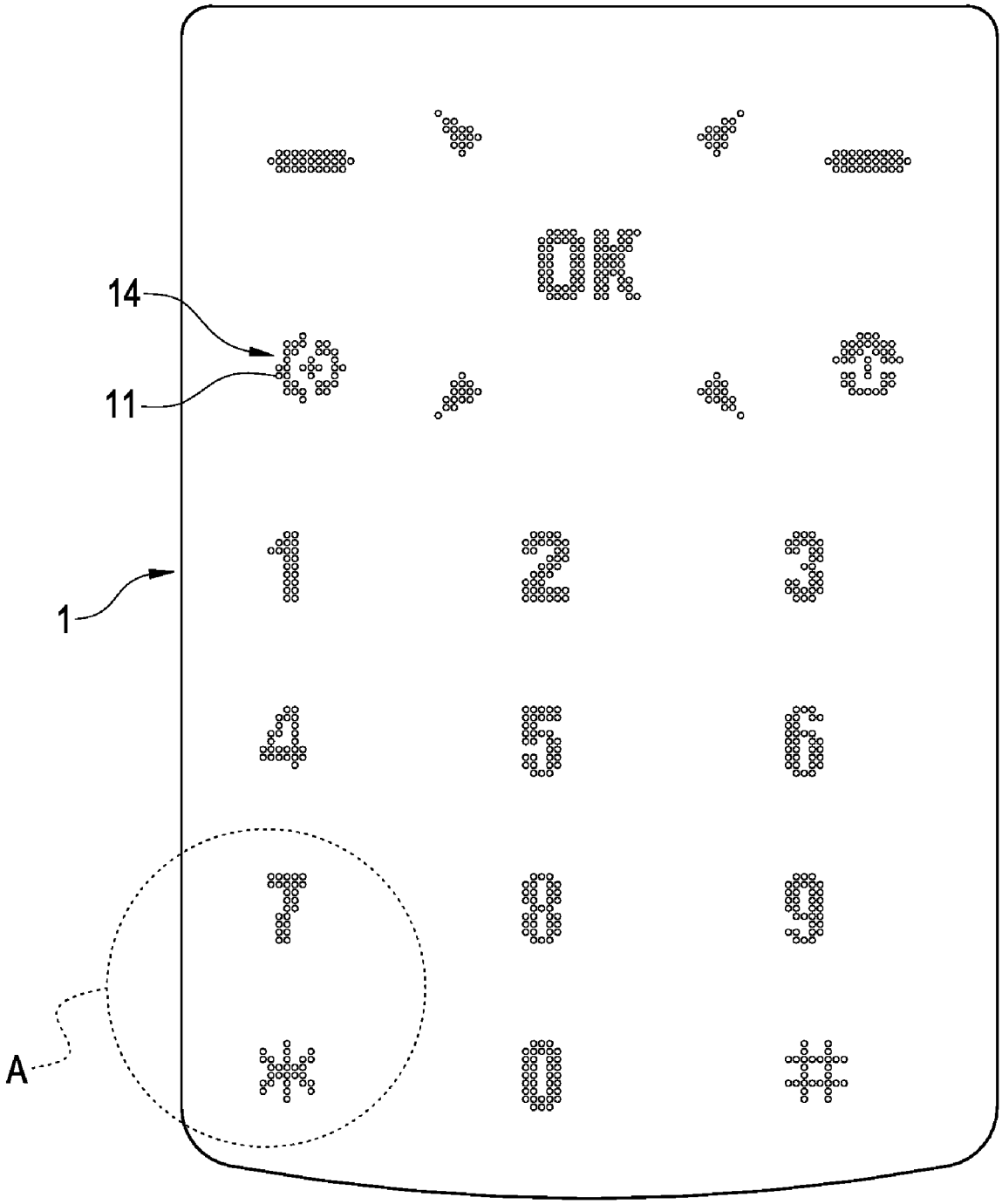
FIGS. 7(*a*) and 7(*b*) are a schematic view of a further preferred embodiment of the present invention and an enlarged view of a portion of FIG. 7(*a*) respectively.
Figure 7B:
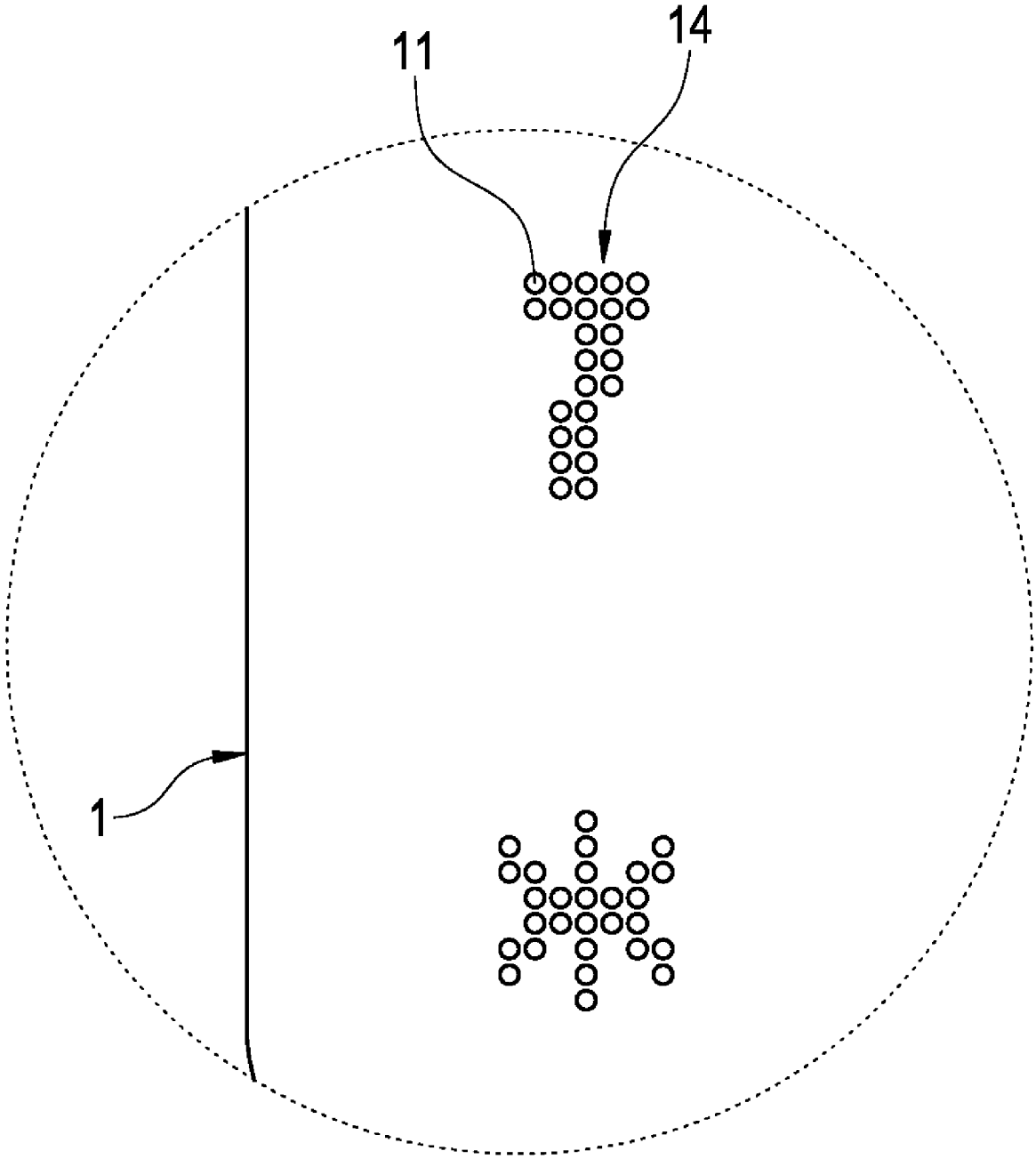

Referring to FIGS. 7(*a*) and 7(*b*) for a further preferred embodiment of the present invention and an enlarged view of a portion FIG. 7(*a*) respectively, micropores 11 are etched on an area of the metal keypad panel 1 that requires a display of the pattern 14, while the micropores 11 of the metal keypad panel 1 are being etched as described in Step 102 of the present invention, and the pattern 14 is comprised of a plurality of micropore 11.

If a light is guided into the backlight module, the light will pass through the micropores 11 of the pattern 14 to display the shape of the pattern 14 such as a number, a text, a special symbol (#, *, .) and a direction symbol, etc.

Figure 8:
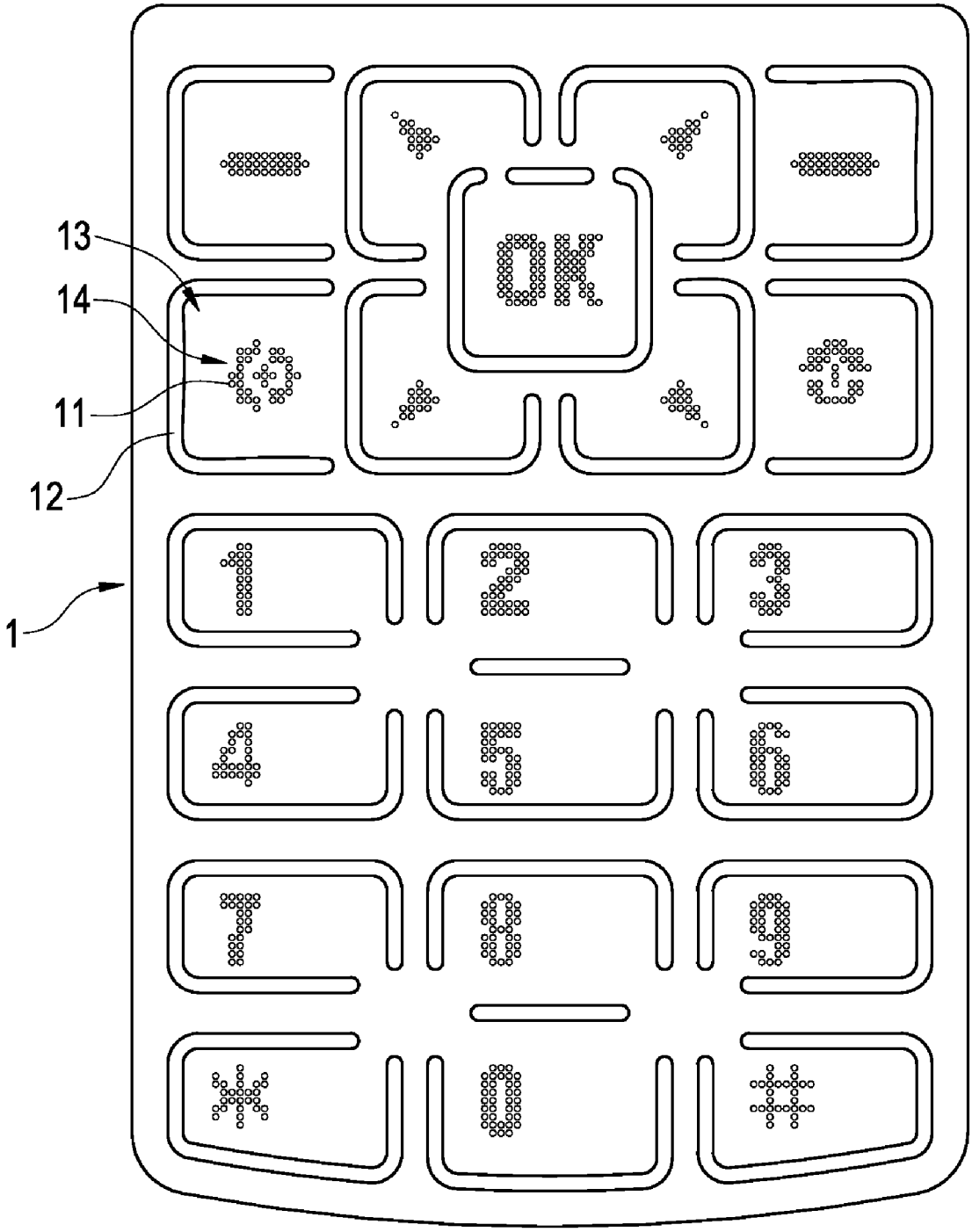
FIG. 8 is a schematic view of another further preferred embodiment of the present invention.

Referring to FIG. 8 for a schematic view of another further preferred embodiment of the present invention, a line hollow portion 12 is etched at the periphery of the pattern 14 while the pattern 14 of the metal keypad panel 1 is being manufactured, and the line hollow portion 12 is enclosed to form a press zone 13. The press zone 13 clearly defines the allocated position of each press key, and the hollow portion 12 is provided for users to press the press zone 13 easily.

Figure 9:
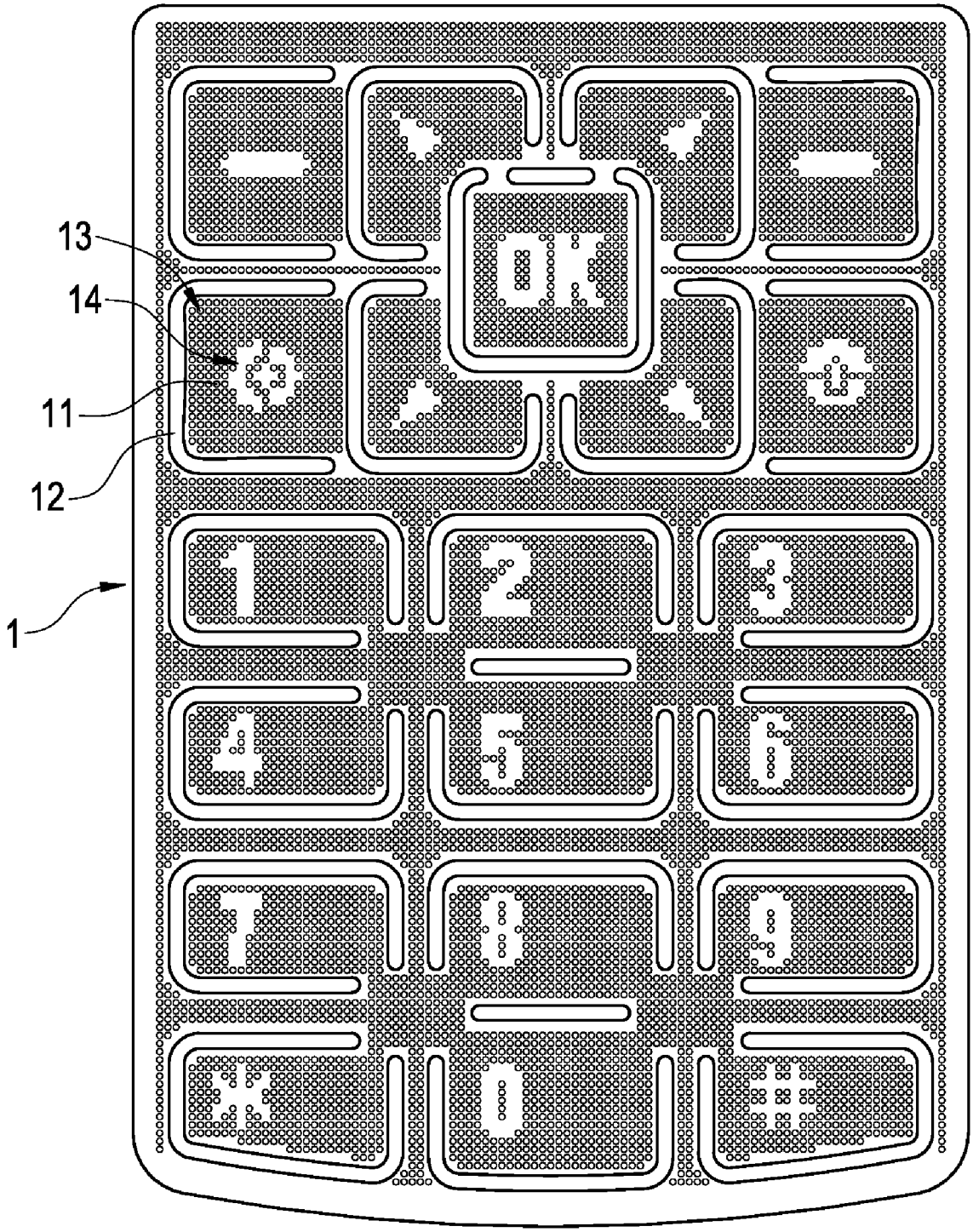
FIG. 9 is a schematic view of another preferred embodiment of the present invention.

Referring to FIG. 9 for a schematic view of a further preferred embodiment of the present invention, a line hollow portion 12 can be etched onto the micropores 11 while the micropores 11 of the metal keypad panel 1 of the present invention is being etched as described in Step 102, and the line hollow portion 12 is enclosed to form a press zone 13, and the press zone 13 allows users to clearly define the allocated position of each press key, and no micropore 11 is designed or formed on the pattern 14 of the press zone 13. Therefore, when the backlight module is lit, the pattern 14 is not transparent, and the micropores 11 on the metal keypad panel 1 and the line hollow portion 12 are transparent, so that users can clearly see the position of each press key.

Figure 10:
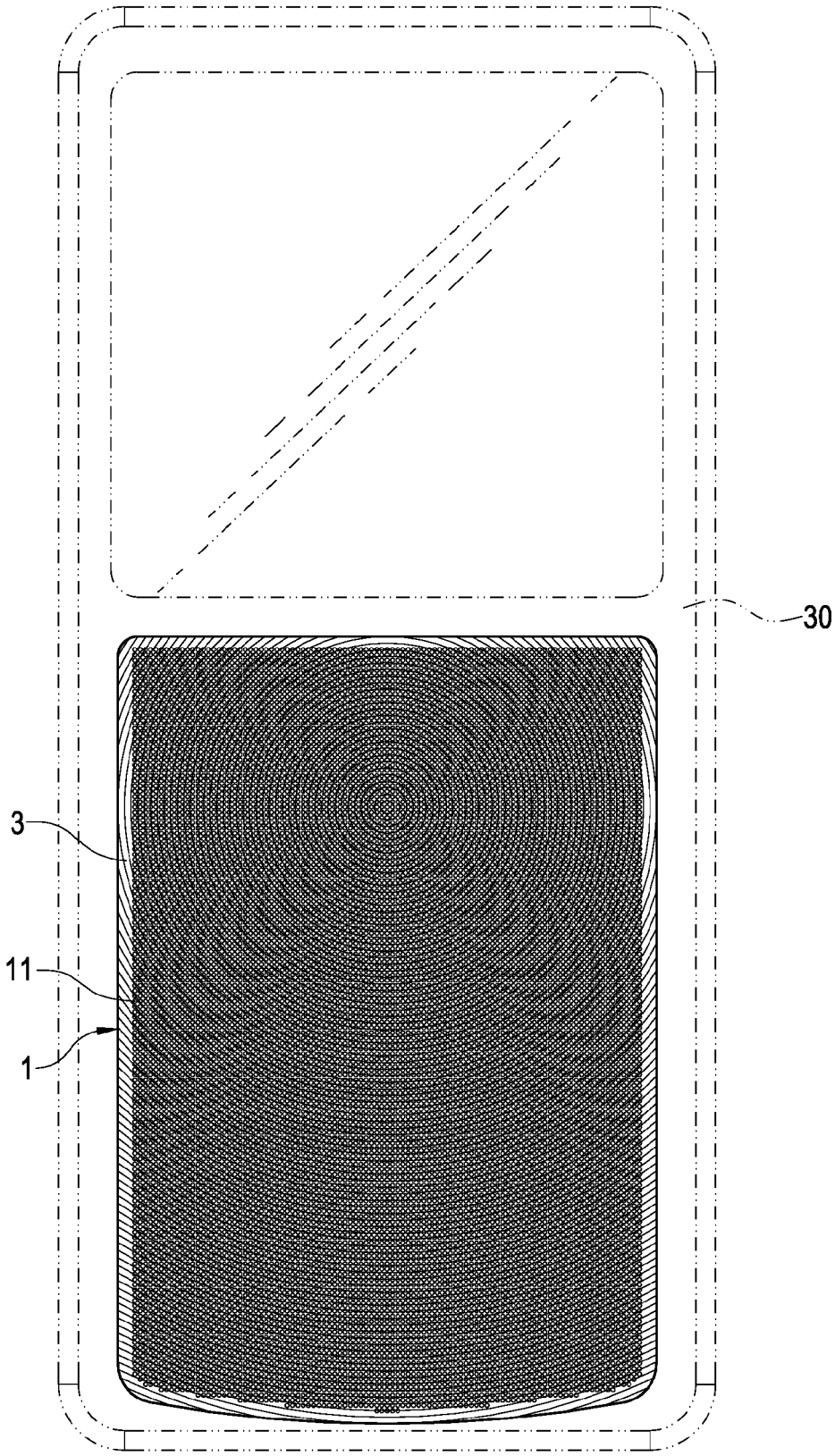
FIG. 10 is a schematic view of a metal keypad panel used in a mobile phone in accordance with the present invention.

Referring to FIG. 10 for a schematic view of a metal keypad panel used in a mobile phone in accordance with the present invention, the manufactured metal keypad panel 1 is used in the mobile phone 30. When an external light is projected onto a pattern layer 3 of the metal keypad panel 1, the pattern layer 3 produces a wavy bright reflecting effect to improve the overall aesthetic appearance of the mobile phone 30. In the meantime, the pattern layer 3 can protect the surface of the metal keypad panel 1 from being damaged by an external hard object.

Figure 11:
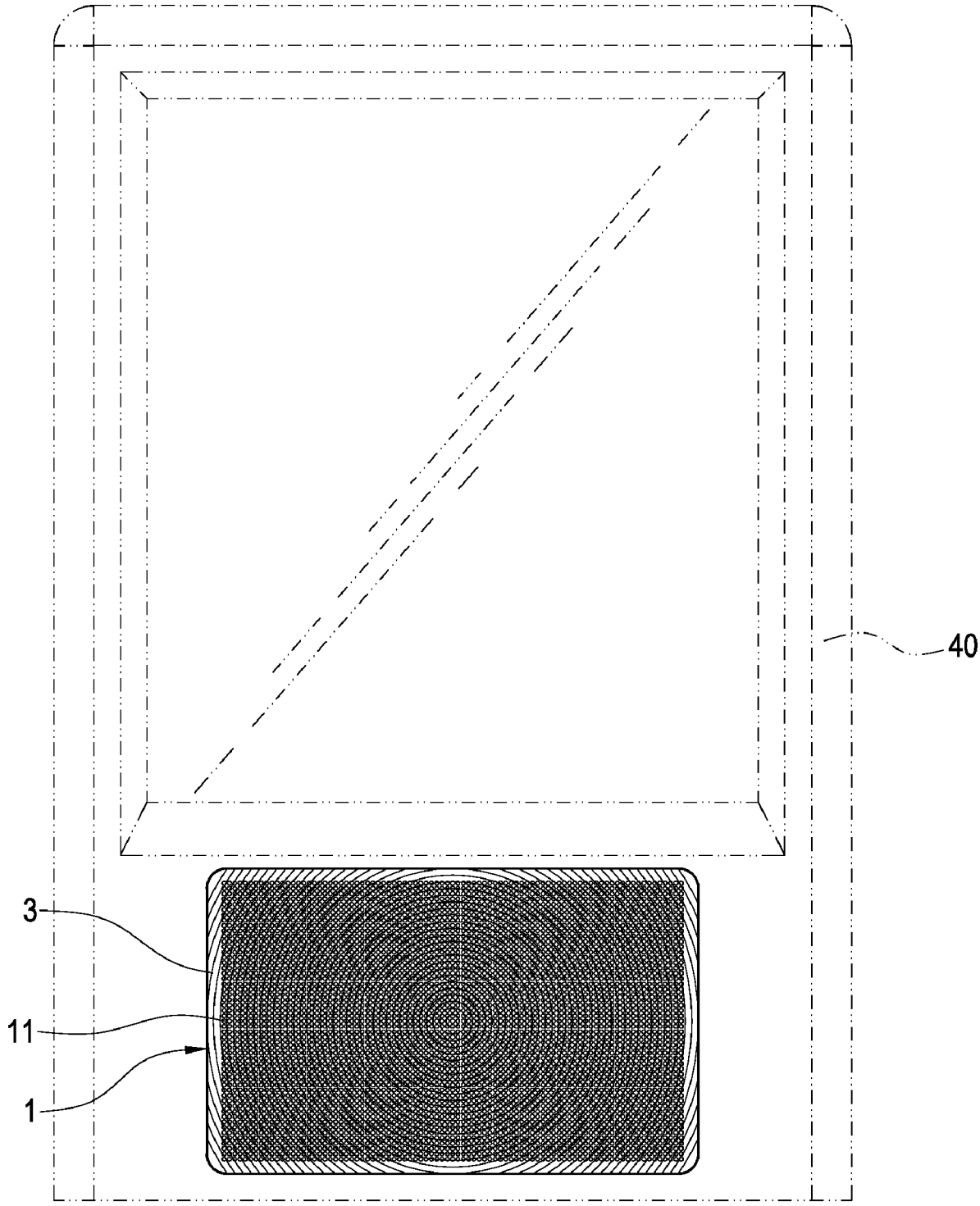
FIG. 11 is a schematic view of a metal keypad panel used in a personal digital assistant in accordance with the present invention.

Referring to FIG. 11 for a schematic view of a metal keypad panel used in a personal digital assistant in accordance with the present invention, the metal keypad panel 1 manufactured according to the method of the invention can be used in a mobile phone 30 as well s in a personal digital assistant (PDA) 40. When the light is projected onto the pattern layer 3 of the metal keypad panel 1, the pattern layer 3 can achieve a wavy bright reflecting effect to improve the overall aesthetic appearance of the personal digital assistant (PDA) 40.

Figure 12:
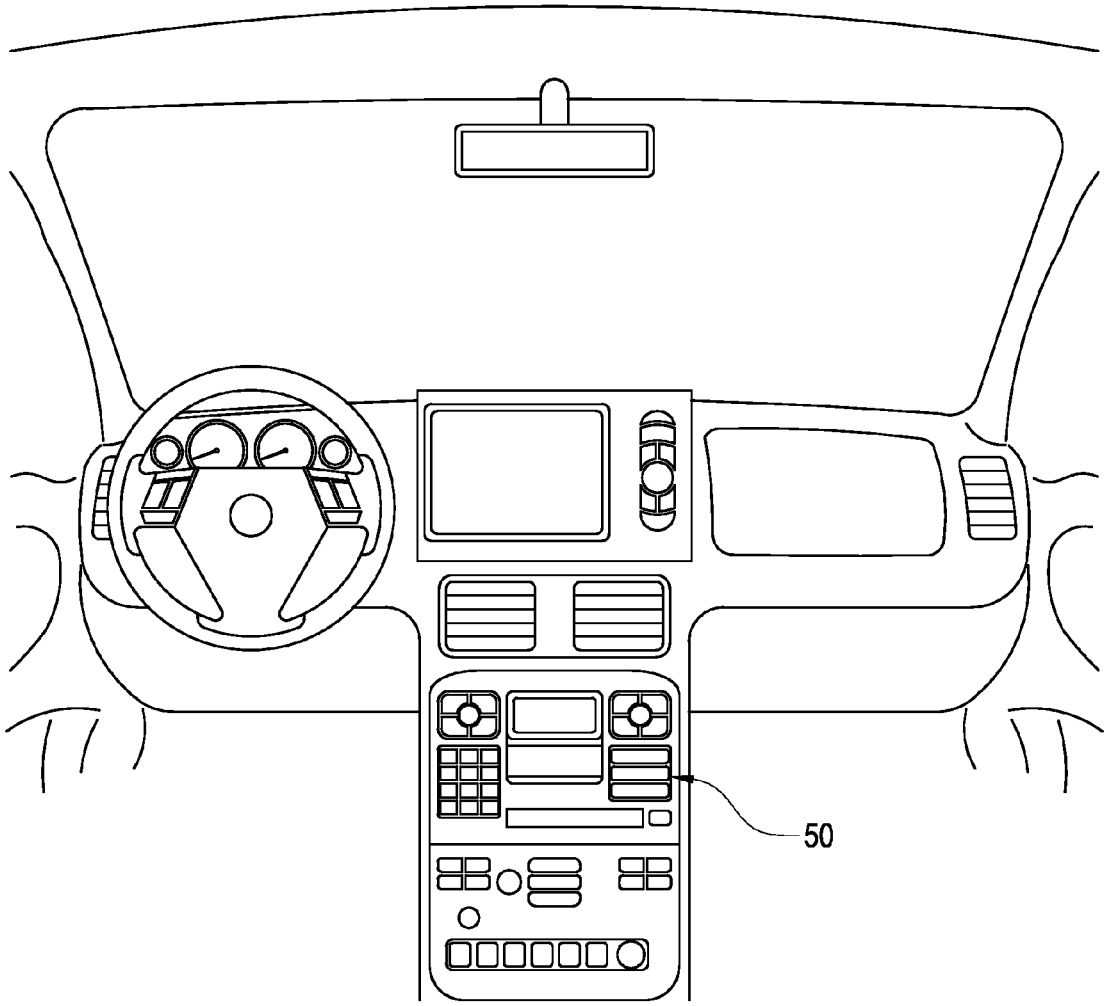
FIG. 12 is a schematic view of a metal keypad panel used on an automobile stereo panel in accordance with the present invention.

Referring to FIG. 12 for a schematic view of a metal keypad panel used on an automobile stereo panel in accordance with the present invention, the keypad panel of the invention can be used in the mobile phone 30 and the personal digital assistant (PDA) 40 and also installed at an automobile stereo panel 50 for controlling the operations of an air-conditioned system, an audio/video system and a satellite navigation system.

While the invention is described in by way of examples and in terms of preferred embodiments, it is to be understood that the invention is not limited thereto. On the contrary, the aim is to cover all modifications, alternatives and equivalents falling within the spirit and scope of the invention as defined by the appended claims.

What is claimed is:

1. A method of manufacturing a metal keypad panel having a micropore array, and the metal keypad panel being installed on a surface of an electronic device, and the method comprising:

(a) preparing a metal laminate;

(b) etching the metal laminate with a plurality of micropore arrays;

(c) filling a filling onto the micropore arrays;

(d) punching the metal laminate to form a single metal keypad panel in a predetermined shape;

(e) attaching a backlight module onto a side of the metal keypad panel, wherein the backlight module is comprised of a light guide plate, a plurality of patterns formed on the light guide plate, and a light guide microstructure formed by the patterns; and (f) attaching a side of the backlight module to an electric signal module, wherein the electric signal module includes a flexible printed circuit board, and the circuit board has a plurality of contact points, and each contact point corresponds to a metal dome, and all of the metal domes are in communication with the keypad such that deformation of different areas of the keypad corresponds to deformation of different metal domes, and then an adhesive layer is adhered onto a side of the circuit board and a side of the metal dome for adhering a layer of a dome membrane, and an adhesive block is coated onto a side of a protruding position of the dome membrane, and a protrusion is adhered onto each adhesive block, and the circuit board has a light source module comprised of a plurality of light emitting diodes, and a position of the light emitting diode for producing a light source corresponds to a side of the light guide plate.

2. The method of manufacturing a metal keypad panel with a micropore array as recited in claim 1, wherein the metal laminate of Step (a) is a material selected from the collection of a stainless steel (SUS) and an aluminum-magnesium alloy.

3. The method of manufacturing a metal keypad panel with a micropore array as recited in claim 1, wherein the metal laminate of Step (a) further comprises a hollow portion in a line shape, and the hollow portion in a line shape is enclosed into a press zone.

4. The method of manufacturing a metal keypad panel with a micropore array as recited in claim 1, wherein the filling of Step (c) is one selected from the collection of an ultraviolet glue, a silicone, a vitro, an epoxy and a synthetic resin.

5. The method of manufacturing a metal keypad panel with a micropore array as recited in claim 1, further comprising a step between Steps (d) and (e), and the step comprising: putting the metal panel into a mold, and forming a pattern layer is formed on a side of the metal keypad panel after a plastic material is injected into the mold, and the plastic material is one selected from the collection of a thermoplastic polyurethane (TPU) and a thermoplastic elastomer (TPE).

6. The method of manufacturing a metal keypad panel with a micropore array as recited in claim 1, wherein the light guide microstructure of Step (e) is concavely disposed in the light guide plate or convexly protruded from any side having the light guide plate.

7. The method of manufacturing a metal keypad panel with a micropore array as recited in claim 6, wherein the patterns include a number, a text, a special symbol and a direction symbol.

* * * * *